US012137798B2

(12) United States Patent
Hachisuka et al.

(10) Patent No.: US 12,137,798 B2
(45) Date of Patent: Nov. 12, 2024

(54) TOOTHBRUSH

(71) Applicant: Lion Corporation, Tokyo (JP)

(72) Inventors: Ryosuke Hachisuka, Tokyo (JP); Masashi Yanagida, Toyama (JP)

(73) Assignee: Lion Corporation, Tokyo (JP)

( * ) Notice: Subject to any disclaimer, the term of this patent is extended or adjusted under 35 U.S.C. 154(b) by 469 days.

(21) Appl. No.: 17/299,778

(22) PCT Filed: Dec. 26, 2019

(86) PCT No.: PCT/JP2019/051160
§ 371 (c)(1),
(2) Date: Jun. 3, 2021

(87) PCT Pub. No.: WO2020/138303
PCT Pub. Date: Jul. 2, 2020

(65) Prior Publication Data

US 2022/0015530 A1 Jan. 20, 2022

(30) Foreign Application Priority Data

Dec. 27, 2018 (JP) ..... 2018-246145

(51) Int. Cl.
*A46B 5/00* (2006.01)
*A46B 5/02* (2006.01)
*A46B 9/04* (2006.01)

(52) U.S. Cl.
CPC ..... *A46B 5/0066* (2013.01); *A46B 5/02* (2013.01); *A46B 9/04* (2013.01); *A46B 2200/1066* (2013.01)

(58) Field of Classification Search
CPC ..... A46B 15/0012; A46B 15/0038; A46B 15/0002; A46B 5/0066; A46B 5/02; A46B 9/04
See application file for complete search history.

(56) References Cited

U.S. PATENT DOCUMENTS

2014/0020198 A1* 1/2014 Slocum ..... A46B 15/004 15/167.1
2016/0088929 A1 3/2016 Lee

FOREIGN PATENT DOCUMENTS

CN 103763981 A 4/2014
JP 06504937 A 6/1994
(Continued)

OTHER PUBLICATIONS

Intellectual Property India, "Examination Report" in connection with related Indian Patent App. No. 202117027897, dated Jul. 29, 2022, 6 pgs.
(Continued)

*Primary Examiner* — Shay Karls
(74) *Attorney, Agent, or Firm* — Kolisch Hartwell, P.C.

(57) ABSTRACT

A toothbrush includes a head portion (10) having a bristle tufting surface; a grip portion (30) disposed on a rear end side from the head portion; a neck portion (20) disposed between the bristle tufting surface (11) and the grip portion; and a sensing portion (70) for sensing that an external force in a first direction orthogonal to the bristle tufting surface exceeds a threshold value. A reversal portion (80) connects a first region and a second region, and snaps, buckles, and reverses as the head portion is displaced on a rear surface side due to the external force exceeding the threshold value. An elastic deformation portion (90) connects the first region and the second region, and elastically deforms at least up to the external force at which the reversal portion snaps, buckles, and reverses.

13 Claims, 5 Drawing Sheets

(56) References Cited

FOREIGN PATENT DOCUMENTS

| | | | | | |
|---|---|---|---|---|---|
| JP | 2003265233 | A | | 9/2003 | |
| JP | 2013043039 | A | | 3/2013 | |
| TW | 222750 | U | | 4/1994 | |
| TW | 201735830 | A | | 10/2017 | |
| WO | 9215224 | A1 | | 9/1992 | |
| WO | WO-0121035 | A1 | * | 3/2001 | ..... A46B 15/0002 |
| WO | WO-2007110208 | A1 | * | 10/2007 | ..... A46B 15/0055 |
| WO | 2012120014 | A1 | | 9/2012 | |
| WO | 2018079115 | A1 | | 5/2018 | |

OTHER PUBLICATIONS

State Intellectual Property Office of the People's Republic of China, "Search Report" in connection with related Chinese Application No. 201980083050.1, dated Mar. 18, 2022, 9 pgs.

Japan Patent Office, "International Search Report" in connection with related International App. No. PCT/JP2019/051160, dated Mar. 24, 2020, 4 pgs.

Taiwan Intellectual Property Office, Office Action and Search Report for related Patent Application No. 108147762, dated Jul. 27, 2023, 6 pgs, partial translation included (Search Report only).

Korean Intellectual Property Office, Office action in connection eith related Korean Patent Application No. 10-2021-7015743, dated May 23, 2024, 19 pgs.

* cited by examiner

TOOTHBRUSH

Priority is claimed on Japanese Patent Application No. 2018-246145 filed on Dec. 27, 2018, the content of which is incorporated herein by reference.

TECHNICAL FIELD

The present invention relates to a toothbrush.

BACKGROUND ART

While the proportion of people at the age of 80 who have 20 teeth is approximately 50%, the proportion of elderly caries (root surface caries) has increased. Root caries is caries of dentin exposed due to gingival recession, and since dentin has a higher composition ratio of organic components than enamel, caries progresses faster. One examples of a cause of gingival recession is over-brushing, in which brushing is performed at a brushing pressure larger than that of an appropriate value.

Since the brushing pressure is defined by a load/bristle tufting area, reducing the brushing pressure can be achieved by at least one of reducing the load and increasing the bristle tufting area. To reduce the load, a toothbrush having a specification designed to incline a neck portion above a bristle tufting surface in advance, to bend the neck portion when brushing, and to be brushed with a force straightening the neck portion when brushing, a soft toothbrush having a specification that uses bristles with a small diameter, a toothbrush having a specification in which the center of gravity of a grip portion is disposed closer to a rear end portion of a handle so that force is not easily applied to a bristle tufting portion, or the like is commercially available. In addition, for increasing the bristle tufting area, a toothbrush having a wide head width and the like are commercially available. Incidentally, in these specifications, although it is possible to reduce the brushing pressure, it is difficult to make all users recognize the appropriate brushing pressure at the same level and control the brushing pressure.

In addition, although users are taught appropriate brushing methods at dentists offices, since it is difficult to deal with the brushing method by oneself because it is not clear how much force is applied, it is found that there are many users who are aware of over-brushing yet continue to over-brush.

Therefore, examples of means for causing a user to recognize an appropriate brushing pressure include a toothbrush disclosed in Patent Document 1. The toothbrush disclosed in Patent Document 1 has a two-beam structure disposed between a head portion and a grip portion, and including a rear side beam to which compressive stress is applied and a facial side beam to which tensile stress is applied during normal use.

In this toothbrush, in a state where the user grips the grip portion, the rear side beam elastically buckles and reverses from an arc protruding upward to an arc protruding downward when a compressive force exceeding the determined force is applied thereto. As described above, the toothbrush disclosed in Patent Document 1 can cause the user to recognize that the appropriate brushing pressure is exceeded by reversing the rear side beam.

CITATION LIST

Patent Document

Patent Document 1

Published Japanese Translation No. H 6-504937 of the PCT International Publication

SUMMARY OF INVENTION

Technical Problem

However, since the toothbrush disclosed in Patent Document 1 described above deforms in the direction where the rear side beam approaches the facial side beam when an excessive brushing load is applied, there is a limit to the amount of deformation of the rear side beam, and it cannot be said that versatility is sufficient.

The present invention has been made in consideration of the above points, and an object thereof is to provide a toothbrush that enables an appropriate brushing pressure to be recognized with high versatility.

Solution to Problem

According to a first aspect of the present invention, there is provided a toothbrush including a head portion provided on a tip end side in a long axis direction and having a bristle tufting surface; a grip portion disposed on a rear end side from the head portion; and a neck portion disposed between the bristle tufting surface and the grip portion; in which a sensing portion for sensing that an external force in a first direction orthogonal to the bristle tufting surface exceeds a threshold value is provided on a rear end side from the bristle tufting surface, the sensing portion includes a reversal portion that connects a first region on the tip end side from the sensing portion and a second region on the rear end side from the sensing portion, and that snaps, buckles, and reverses as the head portion is displaced on a rear surface side opposite to the bristle tufting surface in the first direction due to the external force exceeding the threshold value, and an elastic deformation portion that is disposed with a gap from the reversal portion, connects the first region and the second region, and elastically deforms at least up to the external force at which the reversal portion snaps, buckles, and reverses, and the reversal portion is located between an outer contour on the bristle tufting surface side and an outer contour on the rear surface side of the elastic deformation portion in a side view viewed in a direction orthogonal to the long axis direction and the first direction.

In addition, in the toothbrush according to one aspect of the present invention, the elastic deformation portion and the reversal portion are disposed with a gap in a second direction orthogonal to the first direction and the long axis direction.

In addition, in the toothbrush according to one aspect of the present invention, the elastic deformation portion and the reversal portion are disposed with a gap in a second direction orthogonal to the first direction and the long axis direction.

In addition, in the toothbrush according to one aspect of the present invention, the reversal portion has a protrusion shape toward the rear surface side when the external force in the first direction is equal to or less than the threshold value, and is reversed in a protrusion shape toward the bristle tufting surface side when the external force in the first direction exceeds the threshold value.

In addition, in the toothbrush according to one aspect of the present invention, when the external force in the first direction is equal to or less than the threshold value, the reversal portion is inclined in a direction toward the bristle tufting surface side from an apex of the protrusion shape toward an end portion in the long axis direction, and an angle at which the reversal portion is inclined with respect to a plane parallel to each of the first direction and the long axis direction is 5 degrees or more and 11 degrees or less.

In addition, in the toothbrush according to one aspect of the present invention, the reversal portion includes a groove portion extending in the second direction on at least one of the bristle tufting surface side and the rear surface side in a region including an apex of the protrusion shape.

In addition, in the toothbrush according to one aspect of the present invention, when the reversal portion snaps, buckles, and reverses, a moving distance of an apex of the protrusion shape in the first direction is 0.2 mm or more and 5.0 mm or less.

In addition, in the toothbrush according to one aspect of the present invention, the reversal portion is provided in a center in the second direction, and the elastic deformation portions are provided on both sides in the second direction with the reversal portion interposed therebetween.

In addition, in the toothbrush according to one aspect of the present invention, when a maximum thickness of the reversal portion in the first direction is T, and a maximum thickness of the elastic deformation portion in the first direction is t, a value represented by T/t is 0.05 or more and 0.35 or less.

In addition, in the toothbrush according to one aspect of the present invention, when a maximum width of the reversal portion in the second direction is L, and a maximum width of the elastic deformation portion in the second direction is W, a value represented by L/W is 0.05 or more and 0.35 or less.

In addition, in the toothbrush according to one aspect of the present invention, the reversal portion is made of a hard resin, and a portion of the elastic deformation portion is made of a resin having a hardness different from that of the hard resin.

In addition, in the toothbrush according to one aspect of the present invention, a flexural modulus of the hard resin is 1500 MPa or more and 3500 MPa or less.

In addition, in the toothbrush according to one aspect of the present invention, a portion of the elastic deformation portion is made of a soft resin.

In addition, in the toothbrush according to one aspect of the present invention, the gap is a through-hole extending in the first direction.

Advantageous Effects of Invention

The present invention can provide a toothbrush that enables an appropriate brushing pressure to be recognized with high versatility.

DESCRIPTION OF EMBODIMENTS

Hereinafter, embodiments of a toothbrush of the present invention will be described with reference to FIGS. 1 to 7.

The following embodiments illustrate one aspect of the present invention, do not limit the present invention, and can be randomly changed within the scope of the technical idea of the present invention. In addition, in the following drawings, in order to make each configuration easy to understand, the scale and number of each structure are different from those of the actual structure. In addition, in the following description, a direction orthogonal to a bristle tufting surface in a side view will be described as a vertical direction, a bristle tufting surface side will be described as an upper side, and a rear surface side opposite to the bristle tufting surface will be described as a lower side as appropriate. The vertical direction, the upper side, and the lower side are names used only for description, and do not limit the actual positional relationship and direction in the present invention.

Figure 1:
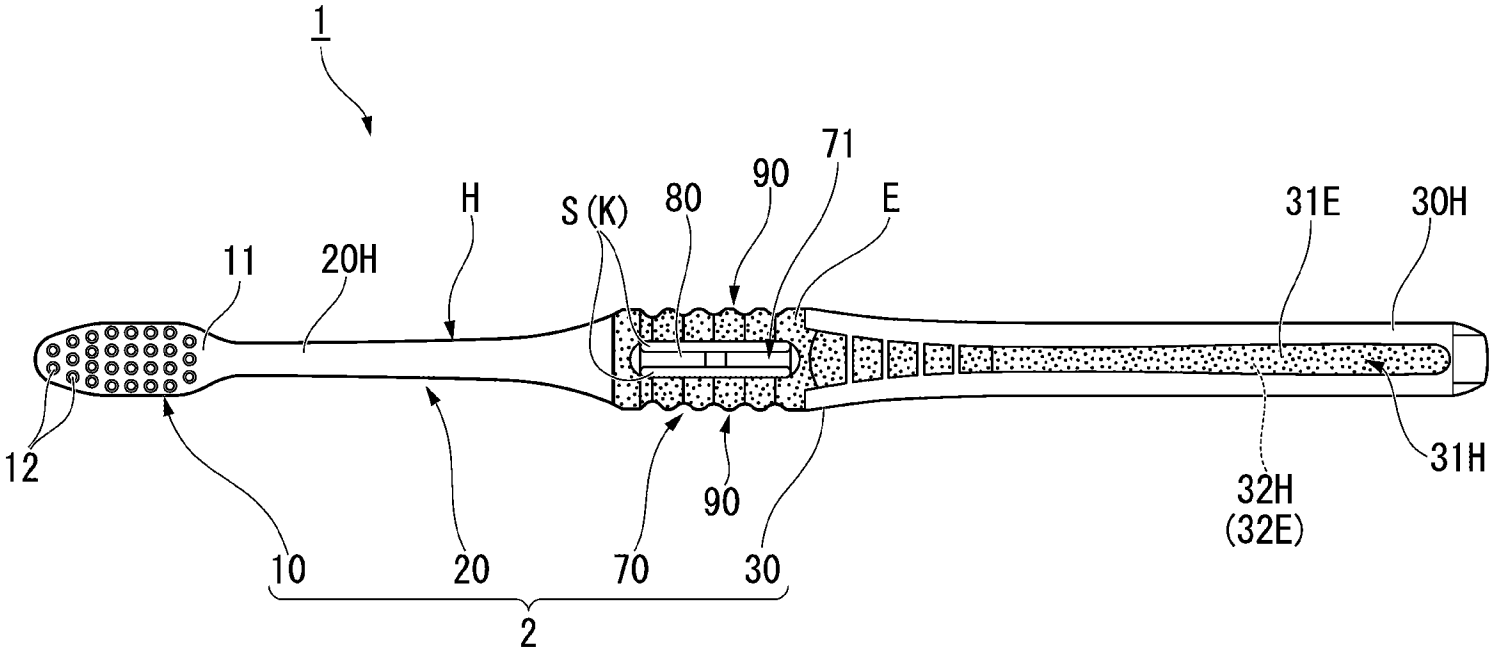
FIG. 1 is a view illustrating an embodiment of the present invention and is a front view of a toothbrush 1.
Figure 2:
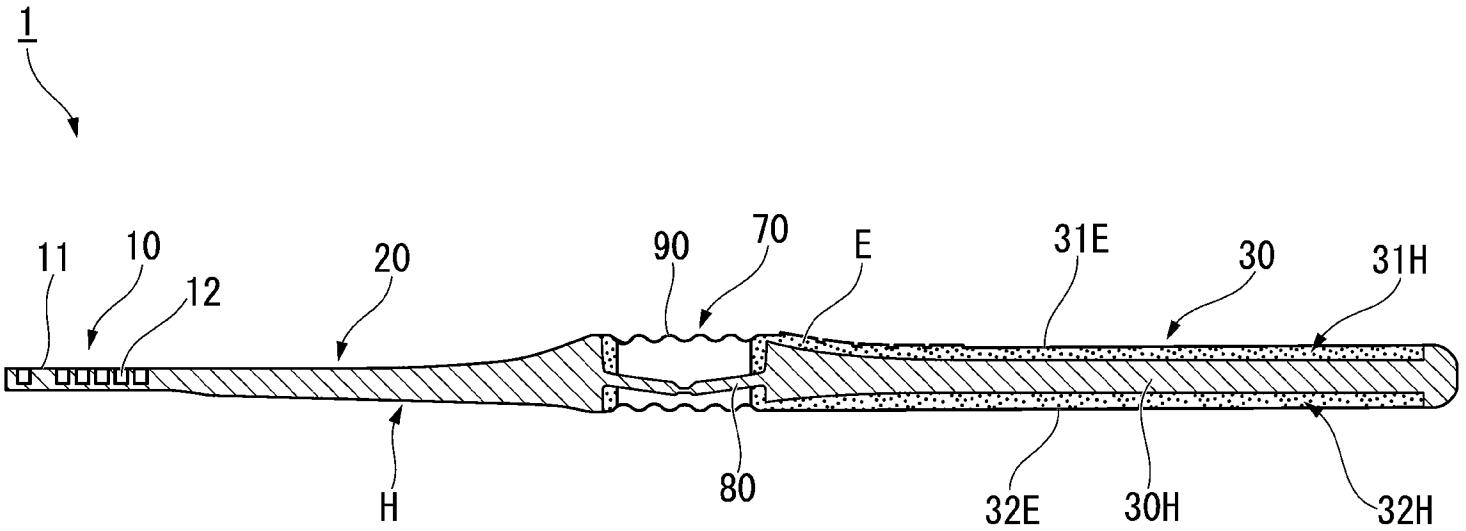
FIG. 2 is a cross-sectional view of the toothbrush 1 along a plane including a center in a width direction.

FIG. 1 is a front view of a toothbrush 1. FIG. 2 is a cross-sectional view of the toothbrush 1 along a plane including a center in a width direction (vertical direction in FIG. 1).

The toothbrush 1 of the present embodiment is provided with a head portion 10 disposed on a tip end side in the long axis direction (hereinafter, simply referred to as a tip end side) and on which a bristle bundle (not illustrated) of bristles is implanted, a neck portion 20 extending on a rear end side of the head portion 10 in the long axis direction (hereinafter, simply referred to as a rear end side), a sensing portion 70 extending to a rear end side of the neck portion 20, and a grip portion 30 extending to a rear end side of the sensing portion 70 (hereinafter, the head portion 10, the neck portion 20, the grip portion 30, and the sensing portion 70 are collectively referred to as a handle body 2).

The toothbrush 1 of the present embodiment is a molded body in which a hard portion H made of a hard resin and a soft portion E made of a soft resin are integrally molded. The hard portion H constitutes at least a portion of each of the head portion 10, the neck portion 20, the grip portion 30, and the sensing portion 70. The soft portion E constitutes a portion of each of the grip portion 30 and the sensing portion 70 (details will be described later).

Head Portion 10

The head portion 10 includes a bristle tufting surface 11 on one side in the thickness direction (direction orthogonal to a paper surface in FIG. 1). Hereinafter, the bristle tufting surface 11 side in the thickness direction is defined as a front surface side in a front surface direction, the side opposite to the bristle tufting surface is defined as a rear surface side, and a direction orthogonal to the thickness direction and the long axis direction is defined as a width direction (or as appropriate, a side surface direction). A plurality of bristle tufting holes 12 are formed on the bristle tufting surface 11. A bristle bundle of bristles (not illustrated) is implanted in the bristle tufting hole 12.

A width of the head portion 10, that is, a length in the width direction parallel to the bristle tufting surface 11 on the front surface side and orthogonal to the long axis direction (hereinafter, simply referred to as a width), is not particularly limited, and is preferably 7 mm or more and 13 mm or less, for example. When the width is the above lower limit value or more, a sufficient area for tufting the bristle bundle can be secured, and when the width is the above upper limit value or less, the operability in the oral cavity is further enhanced.

The length of the head portion 10 in the long axis direction (hereinafter, simply referred to as a length) is not particularly limited, and is preferably 10 mm or more and 33 mm or less, for example. When the length of the head portion 10 is the above lower limit value or more, a sufficient area for tufting the bristle bundle can be secured, and when the length is the above upper limit value or less, the operability in the oral cavity is further enhanced. A boundary between the neck portion 20 and the head portion 10 in the long axis direction in the present embodiment is a position where the width of the neck portion 20 is a minimum value from the neck portion 20 toward the head portion 10.

The length of the head portion 10 in the thickness direction (hereinafter, simply referred to as a thickness) can be determined in consideration of the material and the like, and is preferably 2.0 mm or more and 4.0 mm or less. When the thickness of the head portion 10 is the above lower limit value or more, the strength of the head portion 10 is further enhanced. When the thickness of the head portion 10 is the above upper limit value or less, the reachability to the rear of the molars can be enhanced and the operability in the oral cavity is further enhanced.

The bristle bundle is a bundle of a plurality of bristles. The length (bristle length) from the bristle tufting surface 11 to the tip end of the bristle bundle can be determined in consideration of a bristle waist and the like required for the bristle bundle, and is, for example, 6 to 13 mm. All the bristle bundles may have the same bristle length or may be different from each other.

A thickness of the bristle bundle (bristle bundle diameter) can be determined in consideration of the bristle waist and the like required for the bristle bundle, and is set to, for example, 1 to 3 mm. All the bristle bundles may have the same bristle bundle diameter or may be different from each other.

Examples of the bristles constituting the bristle bundle include bristles in which diameters gradually decrease toward a tip of the bristle and have sharpened tips of the bristles (tapered bristles), and bristles in which diameters from the bristle tufting surface 11 toward a tip of the bristle are substantially the same as each other (straight bristles). Examples of a straight bristle include a bristle in which a tip of the bristle is a plane substantially parallel to the bristle tufting surface 11, and a bristle in which a tip of the bristle is hemispherically rounded.

Examples of the material of the bristle include polyamides such as 6-12 nylon (6-12NY), 6-10 nylon (6-10NY), polyesters such as polyethylene terephthalate (PET), polybutylene terephthalate (PBT), polytrimethylene terephthalate (PTT), polyethylene naphthalate (PEN), polybutylene naphthalate (PBN), polyolefins such as polypropylene (PP), elastomer resins such as polyolefin-based elastomers and styrene-based elastomers, and the like. These resin materials can be used alone or in a combination of two or more. In addition, examples of the bristle include a polyester bristle with a multi-core structure having a core portion and at least one or more layers of sheath portions provided on the outside of the core portion.

The cross-sectional shape of the bristle is not particularly limited, and may be a circular shape such as a perfect circle or an ellipse, a polygonal shape, a star shape, a three-leaf clover shape, a four-leaf clover shape, or the like. The cross-sectional shapes of all the bristles may be the same as each other or different from each other.

The thickness of the bristle can be determined in consideration of the material and the like, and in a case where the cross section is circular, the thickness is, for example, 6 to 9 mil (1 mil=1/1000 inch=0.025 mm). In addition, a plurality of bristles having different thicknesses may be used in any combination in consideration of usability, brushing feeling, cleaning effect, durability, and the like.

Neck Portion 20

The length of the neck portion 20 is preferably 40 mm or more and 70 mm or less in terms of operability.

As an example, the width of the neck portion 20 is formed to gradually increase from a position where the minimum value is obtained toward the rear end side. The neck portion 20 in the present embodiment is formed to gradually increase from a position where the width has a minimum value toward the rear end side. In addition, the neck portion 20 is formed to gradually increase from a position where the thickness has a minimum value toward the rear end side.

The width and thickness of the neck portion 20 at the minimum position are preferably 3.0 mm or more and 4.5 mm or less. When the width and thickness of the neck portion 20 at the minimum position are the above lower limit value or more, the strength of the neck portion 20 is further enhanced. When the width and thickness are the above upper limit value or less, the lips are likely to be closed, the reachability to the molars is enhanced, and the operability in the oral cavity is further enhanced. The width and thickness of the neck portion 20 formed to gradually increase from the position where the minimum value is obtained toward the rear end side can be appropriately determined in consideration of the material and the like.

The front surface side of the neck portion 20 in the side view is inclined toward the front surface side and toward the rear end side. The rear surface side of the neck portion 20 in the side view is inclined toward the rear surface side and toward the rear end side. The neck portion 20 is inclined in a direction where a distance from the center in the width direction increases toward the rear end side in a front view.

The boundary between the neck portion 20 and the sensing portion 70 in the present embodiment is the position of the tip end on the neck portion 20 where an elastic deformation portion 90 that will be described later is provided. Here, the width is expanded from the neck portion 20 toward the grip portion 30 with an arcuate contour in both a front view and a side view, and a position of the center of curvature of the arc coincides with a changed position in the long axis direction. More specifically, the boundary between the neck portion 20 and the sensing portion 70 coincides with a position in the long axis direction where the center of curvature changes from the outside of the arcuate contour to the center side in the width direction in the front view illustrated in FIG. 1. In addition, the boundary between the neck portion 20 and the sensing portion 70 coincides with a position in the long axis direction where the center of curvature changes from the outside of the arcuate contour to the center side in the thickness direction in a side view illustrated in FIG. 2.

Grip Portion 30

The grip portion 30 is disposed in the long axis direction. As illustrated in FIG. 1, a length of the grip portion 30 in the width direction gradually narrows from the boundary with the sensing portion 70 toward the rear end side, and then extends at a substantially constant length. As illustrated in FIG. 2, a length of the grip portion 30 in the thickness direction gradually narrows from the boundary with the sensing portion 70 toward the rear end side, and then extends at a substantially constant length.

The boundary between the sensing portion 70 and the grip portion 30 in the present embodiment is the position of the tip end on the grip portion side 30 where the elastic deformation portion 90 that will be described later is provided. Here, the width is reduced from the sensing portion 70 toward the grip portion side 30 with an arcuate contour in both a front view and a side view, and a position of the center of curvature of the arc coincides with a changed position in the long axis direction. More specifically, the boundary between the sensing portion 70 and the grip portion 30 coincides with a position in the long axis direction where the center of curvature changes from the center side in the width direction to the outside of the arcuate contour in the front view illustrated in FIG. 1. In addition, the boundary between the sensing portion 70 and the grip portion 30 coincides with a position in the long axis direction where the center of curvature changes from the center side in the thickness direction to the outside of the arcuate contour in the side view illustrated in FIG. 2.

The position in the long axis direction where the length of the grip portion 30 in the width direction gradually narrows from the boundary with the sensing portion 70 toward the rear end side and then is a substantially constant length, and the position in the long axis direction where the length of the grip portion 30 in the thickness direction gradually narrows from the boundary with the sensing portion 70 toward the rear end side and then is a substantially constant length are the same as each other.

The grip portion 30 includes a soft portion 31E at the center in the width direction on the front surface side. The soft portion 31E constitutes a portion of the soft portion E. The soft portion 31E gradually narrows from the boundary with the sensing portion 70 toward the rear end side in the front view, and then extends at a substantially constant length. A side edge of the soft portion 31E and a side edge of the grip portion 30 on the outside in the width direction are formed at a substantially constant distance in the front view.

The grip portion 30 includes a hard portion 30H. The hard portion 30H constitutes a portion of the hard portion H. The hard portion 30H includes a hollow 31H in which a portion of the soft portion 31E is embedded on the front surface side. The hollow 31H gradually narrows from the boundary with the sensing portion 70 toward the rear end side in the front view, and then extends at a substantially constant length.

A portion of the soft portion 31E protrudes from the hard portion 30H exposed on the front surface side. The other soft portion 31E is substantially flush with the hard portion 30H exposed on the front surface side.

The grip portion 30 includes a soft portion 32E at the center in the width direction on the rear surface side (refer to FIGS. 1 and 2). The soft portion 32E constitutes a portion of the soft portion E. The soft portion 32E has substantially the same outer contour as the outer contour of the soft portion 31E in the front view. That is, the soft portion 32E gradually narrows from the boundary with the sensing portion 70 toward the rear end side, and then extends at a substantially constant length. In a rear view, a side edge of the soft portion 32E and a side edge of the grip portion 30 on the outside in the width direction are formed at a substantially constant distance.

The hard portion 30H includes a hollow 32H (refer to FIG. 2) in which a portion of the soft portion 32E is embedded on the rear surface side. The hollow 32H gradually narrows from the boundary with the sensing portion 70 toward the rear end side in the rear view, and then extends at a substantially constant length.

A portion of the soft portion 32E protrudes from the hard portion 30H exposed on the rear surface side. The other soft portion 32E is substantially flush with the hard portion 30H exposed on the rear surface side.

Since the soft portion 31E is provided on the front surface side of the grip portion 30 and the soft portion 32E is provided on the rear surface side, the grip property when the grip portion 30 is gripped is improved.

Sensing Portion 70

The sensing portion 70 senses that the external force in the first direction orthogonal to the bristle tufting surface 11 exceeds the threshold value. As illustrated in FIG. 1, the sensing portion 70 includes a reversal portion 80 and an elastic deformation portion 90 which connect the neck portion 20 on the tip end side from the sensing portion 70 and the grip portion 30 on the rear end side from the sensing portion 70.

Figure 3:
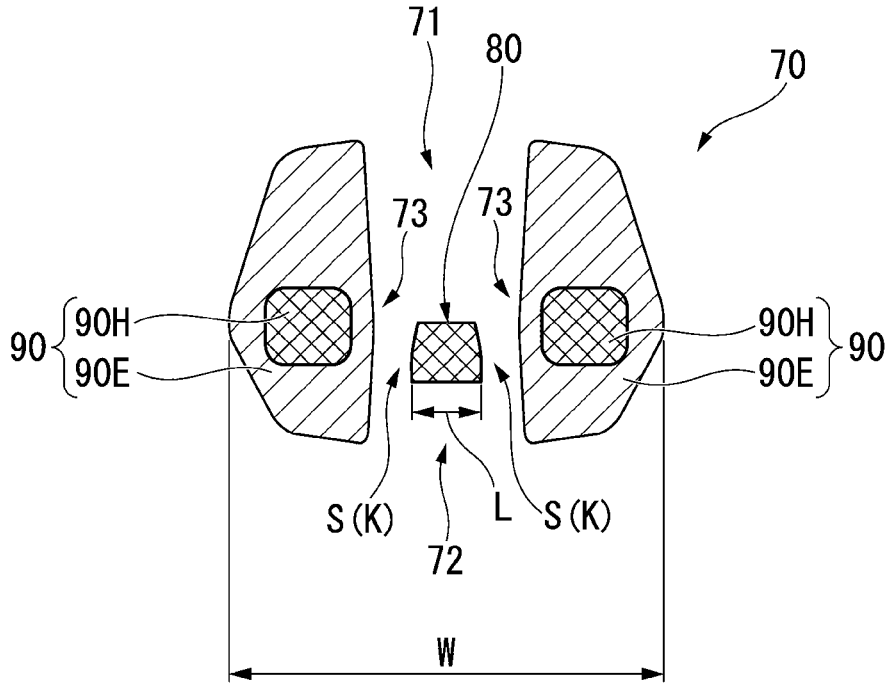
FIG. 3 is a cross-sectional view of a sensing portion 70 along a plane parallel to a thickness direction and the width direction.
Figure 4:
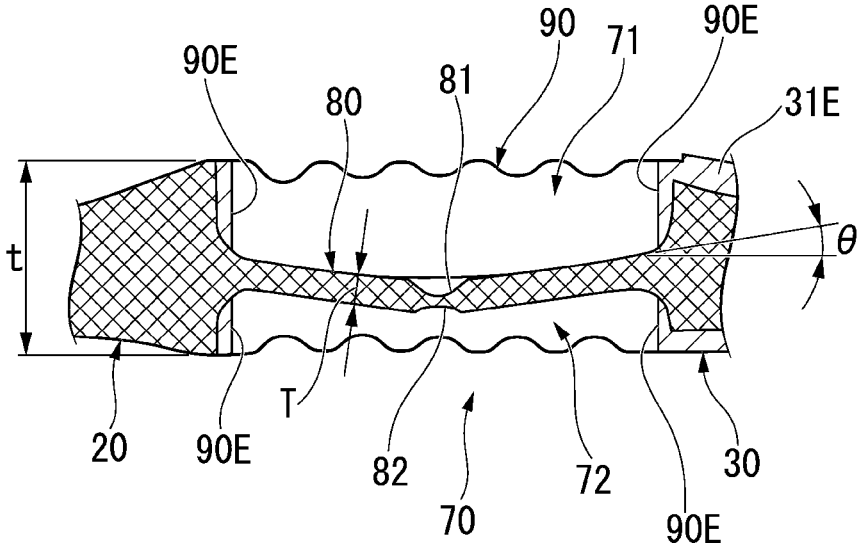
FIG. 4 is a cross-sectional view of the sensing portion 70 along a plane parallel to the thickness direction and a long axis direction.

FIG. 3 is a cross-sectional view of the sensing portion 70 along a plane parallel to a thickness direction and the width direction. FIG. 4 is a cross-sectional view of the sensing portion 70 along a plane parallel to the thickness direction and a long axis direction.

As illustrated in FIG. 3, the elastic deformation portions 90 are each provided with gaps S on both sides of the reversal portion 80 in the width direction. The gaps S include a through-hole K penetrating in the thickness direction. As illustrated in FIG. 1, the through-hole K is formed in a rectangular shape in a plan view extending in the long axis direction.

By providing the gaps S, the reversal portion 80 can be reversed (easily reversed) without interfering with the periphery structure. In addition, since the deformation of the reversal portion 80 does not follow the deformation of the elastic deformation portion (because there is no interference), the functional roles (to be described later) of the reversal portion 80 and the elastic deformation portion 90 can be made independent. As a result, for example, the degree of freedom in design for obtaining the following effects can be enhanced. For example, vibration or sound when the reversal portion 80 that will be described later is reversed can be clearly generated. In addition, for example, a repulsive force up to the threshold value can be increased in proportion to the displacement amount, and in particular, the proportional relationship can be maintained even in the vicinity of the threshold value (the degree of increase in the repulsive force is not relaxed). As a result, the pressure assumed by the user is directly reflected in the repulsive force in the region up to the displacement amount reaching the upper limit pressure, so that the brushing load can be appropriately controlled. In a case where the degree of increase in the repulsive force is gradually relaxed in the vicinity of the threshold value, the user may unintentionally continue brushing at a pressure near the upper limit. In addition, when the gaps S are communicated with both sides of the reversal portion 80 in the thickness direction, the effect is further improved. By widening the gaps S in the thickness direction, the vector of the load applied to a brush portion (bristle) during brushing, the direction where the gaps open, and the direction where the reversal portion 80 and the elastic deformation portion 90 are deformed are made parallel to each other (refer to FIG. 7), and it is easy to link the generation of vibration or sound due to reversing with the brushing load. Furthermore, when the gaps S are passed through the front surface side and the rear surface side by the through-hole K, for example, the movable region of the elastic deformation portion 90 which is responsible for the bending function of the toothbrush skeleton with respect to the load during brushing can be further expanded (the tensile behavior on the front surface and the compression behavior on the rear surface due to bending are unlikely to be hindered). In a case where there is no through-hole K between the elastic deformation portion 90 and the reversal portion 80, the movable region of the elastic deformation portion 90 is narrow. In this case, the reversal portion 80 is not assigned an opportunity to reverse in an appropriate load range, and it is assumed that the reversal portion 80 is reversed before reaching the appropriate load range, or is not reversed even within the appropriate load range. On the other hand, by providing the through-hole K between the elastic deformation portion 90 and the reversal portion 80, the "threshold value" at which the reversal portion 80 described later reverses can be controlled in a fine range. The gaps S may not penetrate in the thickness direction, and may be formed inside the elastic deformation portion 90 by a closed cavity extending in the long axis direction. In addition, the gaps S may include hollows (to be described later) that open on the front surface side or the rear surface side.

Each elastic deformation portion 90 includes a hard portion 90H and a soft portion 90E. As illustrated in FIG. 1, the hard portion 90H and the soft portion 90E connect a rear end of the neck portion 20 and a front end of the grip portion 30. As illustrated in FIGS. 3 and 4, a hollow (recessed portion) 71 that opens on the front surface side and a hollow (recessed portion) 72 that opens on the rear surface side are provided between the pair of elastic deformation portions 90. The bottom portions of the hollow 71 and the hollow 72 on both end sides in the width direction are connected to the through-holes K. The reversal portion 80 is exposed and provided at the bottom portions of the hollow 71 and the hollow 72 at the center in the width direction. By providing the hollows 71 and 72, for example, the movable region of the elastic deformation portion that bears the bending function of the toothbrush skeleton with respect to the load during brushing can be further expanded, and the bending anisotropy in the thickness direction can be improved. The hollows between the pair of elastic deformation portions 90 may not penetrate in the thickness direction, or may open in only one of the thickness directions. In addition, for example, a closed cavity extending in the long axis direction may be formed inside the elastic deformation portion 90, and the cavity may be interposed in the center to form a pair of elastic deformation portions in the width direction.

In the pair of elastic deformation portions 90, the end portions of the soft portions 90E in the long axis direction are connected to each other in the width direction on both the front surface side and the rear surface side. The soft portions 90E of the pair of elastic deformation portions 90 are provided at the periphery of the oval hollows 71 and 72 in the front view. The rear end side of the soft portion 90E is connected to the soft portion 31E of the grip portion 30.

Since the soft portion 90E is connected in the width direction on both the tip end side and the rear end side of the elastic deformation portion 90, stress is unlikely to be concentrated on the end of the hinge structure even when the reversing is repeated, and it is unlikely to break. In addition, the anisotropy in the sensing portion 70 is increased by connecting the soft portions 90E in the width direction on both the tip end side and the rear end side of the elastic deformation portion 90. For example, the pair of elastic deformation portions 90 can be bent without twisting in the thickness direction with respect to the movement during brushing. Furthermore, since the soft portion 90E is connected in the width direction, the amount of heat possessed by the soft resin (elastomer) during injection molding increases, which enhances the adhesiveness between the neck portion 20 and the sensing portion 70 (neck portion 20 and elastic deformation portion 90).

Figure 5:
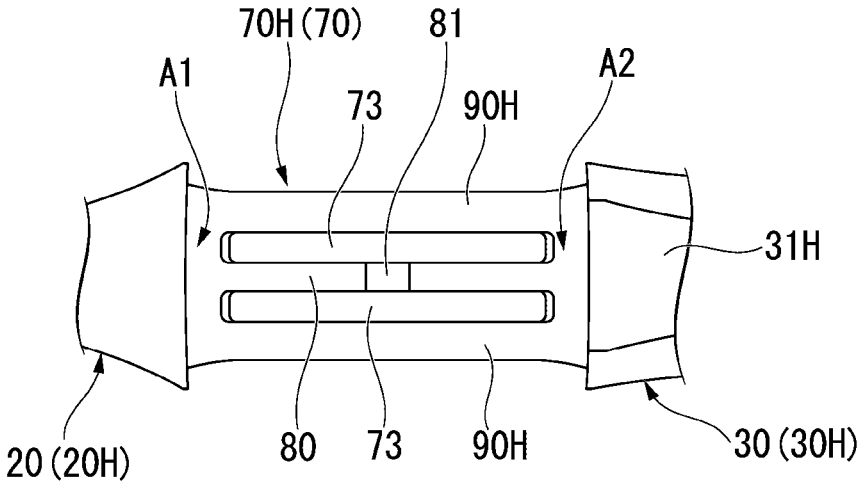
FIG. 5 is a partial front view in a vicinity of the sensing portion 70 in a hard portion 70H.
Figure 6:
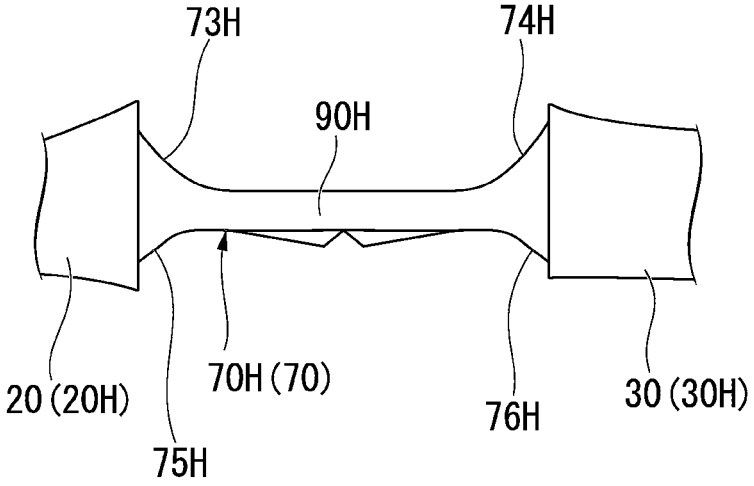
FIG. 6 is a partial side view in the vicinity of the sensing portion 70 in the hard portion 70H.
Figure 7:
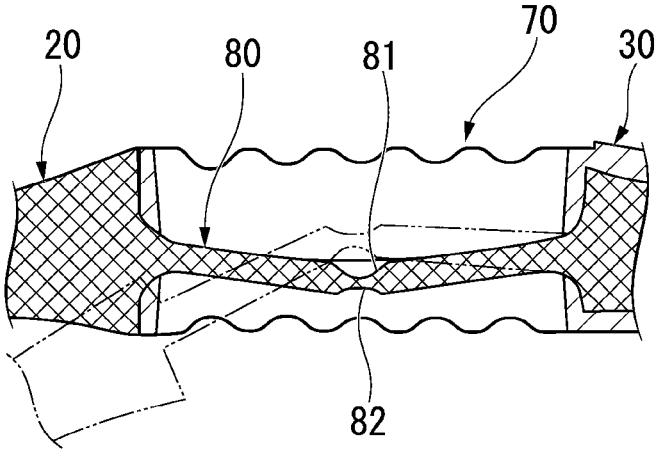
FIG. 7 is a cross-sectional view of the sensing portion 70 along a plane parallel to the thickness direction and the long axis direction for describing reversal of a reversal portion.

FIG. 5 is a partial front view in a vicinity of a hard portion 70H in the sensing portion 70. FIG. 6 is a partial side view in the vicinity of the hard portion 70H in the sensing portion 70.

As illustrated in FIG. 5, the hard portion 70H is formed in a rectangular shape in a plan view connecting the hard portion 20H which is the neck portion 20 and the hard portion 30H of the grip portion 30 in the long axis direction.

As illustrated in FIG. 6, the tip end side of the hard portion 70H on the front surface side is connected to the hard portion 20H by a curved surface 73H having an arc shape in the side view. The rear end side of the hard portion 70H on the front surface side is connected to the hard portion 30H by a curved surface 74H having an arc shape in the side view. The arc centers of the curved surfaces 73H and 74H are located on the front surface side from the hard portion 70H in the side view. The tip end side of the hard portion 70H on the rear surface side is connected to the hard portion 20H by a curved surface 75H having an arc shape in the side view. The rear end side of the hard portion 70H on the rear surface side is connected to the hard portion 30H by a curved surface 76H having an arc shape in the side view. The arc centers of the curved surfaces 75H and 76H are located on the rear surface side from the hard portion 70H in the side view.

In a case where the curved surfaces 73H to 76H do not exist, stress may be concentrated on the boundary between the tip end side of the hard portion 70H and the hard portion 20H and the boundary between the rear end side of the hard portion 70H and the hard portion 30H. On the other hand, since the curved surfaces 73H to 76H exist, the concentrated stress can be relaxed. Furthermore, since the curved surfaces 73H to 76H exist, both the elastic deformation portion 90 and the tip end side and the rear end side of the reversal portion 80 can be flexibly deformed (the degree of deformation of the elastic deformation portion 90 that triggers reversing can be sensed more finely).

The hard portion 70H includes through-holes 73 provided on both sides of the reversal portion 80 in the width direction. The through-holes 73 extend in the long axis direction. The length of the through-hole 73 in the long axis direction is a length at which a tip end side end portion of the through-hole 73 is separated from the hard portion 20H and a rear end side end portion of the through-hole 73 is separated from the hard portion 30H. As illustrated in FIG. 3, of the through-holes 73, the soft portion 90E is provided near the hard portion 90H in the width direction, and the through-hole K is formed near the reversal portion 80 in the width direction.

In the hard portion 70H, since the hard portions 90H are disposed on both sides in the width direction with the reversal portion 80 as the center through the through-hole 73, even when a load is applied and the elastic deformation portion 90 is deformed, the shape of the reversal portion 80 can be maintained. When the hard portion H constituting the toothbrush 1 over the entire length is bent, the reversal portion 80 of the sensing portion 70 is reversed in an attempt to release the accumulated strain energy. For example, in a case where the hard portion 70H is connected to the neck portion 20 and the grip portion 30 only by the reversal portion 80, since the energy cannot be accumulated, the hard portion 70H is immediately reversed. When the reversal portion 80 is integrally injection-molded with a first region A1 and a second region A2 that will be described later, the neck portion 20, the grip portion 30, and the hard portion 70H, the accumulated strain energy can be efficiently transferred to the reversal portion.

The hard portion 90H is formed on the outside of the hard portion 70H in the width direction from the through-hole 73. As illustrated in FIG. 3, the hard portion 90H has a substantially rectangular cross-sectional shape. The hard portion 90H is embedded in the soft portion 90E. Since the hard portion 90H is embedded in the soft portion 90E, the stress applied to the hard portion 90H can be relaxed from the viewpoint of strength. In addition, from the viewpoint of the degree of bending of the toothbrush 1 with respect to the load, it is possible to control the elastic behavior of the elastic deformation portion 90. In addition, the bending anisotropy of a sensing portion 70 is increased, and for example, the elastic deformation portion 90 can be bent without twisting in the thickness direction with respect to the movement during brushing.

Examples of the material of the hard portion H include a resin having a flexural modulus (JIS7171) of 1500 MPa or more and 3500 MPa or less, and for example, include a polyacetal resin (POM). The flexural modulus of the hard portion H is more preferably 2000 MPa or more and 3500 MPa or less. By using a material having a high elastic modulus (for example, POM), even when the shape is made narrow or thin, when an excessive load is applied, snap buckling occurs and vibration is developed. In addition, by using a material having a high elastic modulus, it is possible to rapidly return to an initial state (state where the bending of the elastic deformation portion 90 is released) after the snap buckling occurs.

As an example, the material of the soft portion E preferably has a shore hardness A of 90 or less, and more preferably a shore hardness A of 50 to 80, so that the load when the snap buckling occurs is close to a recommended brushing load value. Examples of the soft resin include elastomers (for example, olefin-based elastomers, styrene-based elastomers, polyester-based elastomers, and polyurethane-based thermoplastic elastomers) and silicones. A styrene-based elastomer is preferable because styrene-based elastomers have excellent miscibility with polyacetal resins.

As illustrated in FIG. 5, the reversal portion 80 extends in the long axis direction in the front view, and connects the first region A1 on the tip end side of the through-hole 73 and the second region A2 on the rear end side of the through-hole 73 in the hard portion 70H. The reversal portion 80 is formed in substantially a V shape in a side view which gradually inclines toward the rear surface side from both end portions in the long axis direction toward the center, in a first stable state (hereinafter referred to as a first state) illustrated in FIG. 4 in which no external force is applied to the rear surface side of the head portion 10 (or an external force equal to or less than a predetermined threshold value that will be described later is applied). That is, in the first state, the reversal portion 80 is formed in a protrusion shape on the rear surface side where the center in the long axis direction is the apex.

For example, when an external force to the rear surface side is applied to the head portion 10 while the grip portion 30 is gripped, in a case where the magnitude of the external force is equal to or less than a predetermined threshold value, the elastic deformation portion 90 and the reversal portion 80 are elastically deformed according to the magnitude of the external force.

In a case where the magnitude of the external force exceeds a predetermined threshold value, the elastic deformation portion 90 elastically deforms according to the magnitude of the external force exceeding the threshold value. On the other hand, in a case where the magnitude of the external force exceeds a predetermined threshold value, as illustrated by a two dot chain line in FIG. 7, the reversal portion 80 snaps, buckles, and reverses to a second stable state (hereinafter referred to as a second state) when the neck portion 20 is deformed. In the second state, the reversal portion 80 is reversed in a direction that is substantially a reversed V shape in the side view which gradually inclines toward the front surface side toward the center. In the second state, the reversal portion 80 is formed in a protrusion shape on the front surface side where the center in the long axis direction is the apex.

That is, in a case where the magnitude of the external force exceeds a predetermined threshold value, since the elastic deformation portion 90 elastically deforms, the reversal portion 80 snaps, buckles, and reverses from the first state to the second state, in a state where the bending strength of the sensing portion 70 is ensured. In addition, since the through-hole K is provided between the reversal portion 80 and the elastic deformation portion 90, the reversal portion 80 and the elastic deformation portion 90 can be deformed independently of each other, and the reversal portion 80 can be easily reversed. That is, since the through-hole K is provided when a brushing load is applied, the reversal portion 80 can be bent after only the elastic deformation portion 90 is first bent without either hindering the deformation behavior of the other. The space between the reversal portion 80 and the elastic deformation portion 90 does not necessarily penetrate, and a gap S may be formed.

Due to the vibration when the reversal portion 80 snaps, buckles, and reverses, the user who grips the grip portion 30 can sense an over-brushing state in which the external force applied to the head portion 10 on the rear surface side exceeds the threshold value.

The reversal portion 80 includes a groove portion 81 at the center in the long axis direction on the front surface side, that is, in a region including an apex of the protrusion shape. The reversal portion 80 includes a groove portion 82 at the center in the long axis direction on the rear surface side, that is, in a region including the apex of the protrusion shape. The groove portions 81 and 82 extend in the width direction. The groove portion 81 is formed in an arc shape in the side view in which the center of the arc is disposed on the front surface side. The groove portion 82 is formed in an arc shape in the side view in which the center of the arc is disposed on the rear surface side. In a case where the reversal portion 80 is not provided with the groove portions 81 and 82, stress is uniformly generated in the entire reversal portion 80, and snap buckling is unlikely to occur. On the other hand, when the groove portions 81 and 82 are provided in the reversal portion 80, stress is intensively generated in the groove portions 81 and 82, and snap buckling is likely to occur.

The radius of the arc-shaped groove portions 81 and 82 in the side view is preferably 1 mm or more and 2 mm or less. In a case where the radius of the groove portions 81 and 82 is less than 1 mm, the reversal portion 80 may not be reversed. In a case where the radius of the groove portions 81 and 82 exceeds 2 mm, the vibration of the reversal portion 80 at the time of reversing is decreased, and it may be difficult to sense that the reversal portion 80 is in the over-brushing state.

As for the depth of the groove portions 81 and 82, it is preferable that the groove portion 81 be deeper than the groove portion 82. In a case where the groove portion 82 is deeper than the groove portion 81, the reversal portion 80 is unlikely to be reversed even in a case where the magnitude of the external force exceeds a predetermined threshold value. In addition, in a case where the groove portion 81 is deeper than the groove portion 82, the reversal portion 80 can be guided to be more likely to snap and buckle on the front surface side.

Configurations in which neither of the groove portions 81 and 82 is provided, and in which the groove portion 82 is not provided and only the groove portion 81 is provided are also possible.

Since the reversal portion 80 is provided with the groove portions 81 and 82 in the region including the apex of the protrusion shape, the region including the apex of the protrusion shape is thinner than the other regions. Therefore, the strain energy accumulated by the deformation of the reversal portion 80 due to the external force exceeding the threshold value can be instantly released starting from the groove portions 81 and 82, and the reversal portion 80 can be reversed. In addition, the positions of the groove portions 81 and 82 in the thickness direction can be adjusted to adjust the position where the reversal portion 80 reverses from the first state to the second state.

In addition, since the groove portions 81 and 82 are formed in an arc shape in the side view, for example, as compared with the case where the groove portions 81 and 82 are formed in a V shape on two intersecting planes, even when the apex of the reversal portion 80 including the groove portions 81 and 82 moves in the thickness direction, the stress concentration at the apex can be relaxed.

The threshold value of the external force applied to the head portion 10 on the rear surface side is, for example, an upper limit value of an appropriate brushing pressure.

As illustrated in FIG. 4, the angle θ at which the reversal portion 80 is inclined to the plane parallel to the long axis direction and the width direction is preferably 5 degrees or more and 11 degrees or less, and more preferably 7 degrees or more and 11 degrees or less. In a case where the inclination angle θ is less than 5 degrees, since the reversal portion 80 is deformed without snap buckling, it may be difficult to sense that it is in the over-brushing state. In a case where the inclination angle θ exceeds 11 degrees, it may be difficult for the reversal portion 80 to snap, buckle, and reverse due to the over-brushing pressure, or when the reversal portion 80 snaps, buckles, and reverses, the reversal portion 80 may break and lose reversibility.

The thickness of the reversal portion 80 is preferably 1 mm or more and 2 mm or less, excluding the groove portions 81 and 82. In a case where the thickness of the reversal portion 80 is less than 1 mm, the reversal portion 80 does not snap and buckle when deformed, and it may be difficult to sense that it is in an over-brushing state. When the thickness of the reversal portion 80 exceeds 2 mm, it may be difficult for the reversal portion 80 to snap, buckle, and reverse due to the over-brushing pressure, or when the reversal portion 80 snaps, buckles, and reverses, the reversal portion 80 may break and lose reversibility.

Assuming that the maximum thickness of the reversal portion 80 is T (mm) and the maximum thickness of the sensing portion 70 is t (mm), by defining a value represented by T/t, it is possible to control the ease of reversing of the reversal portion 80 and the timing (threshold value) thereof when an excessive brushing load is applied. The value represented by T/t is preferably 0.05 or more and 0.35 or less, and more preferably 0.10 or more and 0.35 or less. In a case where the value represented by T/t is less than 0.05, although the reversal portion 80 also deforms in a form that follows the bending of the sensing portion 70 (elastic deformation portion 90), the reversal portion 80 does not snap and buckle, and therefore it can be difficult to sense an over-brushing state. When the value represented by T/t exceeds 0.35, it may be difficult for the reversal portion 80 to snap, buckle, and reverse due to the over-brushing pressure, or when the reversal portion 80 snaps, buckles, and reverses, the reversal portion 80 may break and lose reversibility.

That is, by setting T/t within the above ranges, the bending strength of the reversal portion 80 is flexible at a constant ratio for the elastic deformation portion 90, and the reversal portion 80 can be operated with a slight delay for the bending of the elastic deformation portion 90 that bears the handle skeleton. As a result, even when an excessive brushing load is applied, it is possible to control the ease of reversing of the reversal portion 80 and the timing (threshold value) that triggers the reversal portion 80 to reverse.

As illustrated in FIG. 3, assuming that the maximum width of the reversal portion 80 is L (mm) and the maximum width of the sensing portion 70 is W (mm), by defining a value represented by L/W, for example, it is possible to control the ease of reversing of the reversal portion 80 and the timing (threshold value) thereof when an excessive brushing load is applied. The value represented by L/W is preferably 0.05 or more and 0.35 or less, and more preferably 0.10 or more and 0.35 or less. In a case where the value represented by L/W is less than 0.05, although the reversal portion 80 also deforms in a form that follows the bending of the sensing portion 70 (elastic deformation portion 90), the reversal portion 80 is unlikely to snap and buckle, and therefore it can be difficult to sense an over-brushing state. When the value represented by L/W exceeds 0.35, the reversal portion 80 is unlikely to be deformed and reversed due to the bending of the handle body 2 that occurs in the range of normal brushing. Therefore, it may be difficult for the reversal portion 80 to snap, buckle, and reverse due to the over-brushing pressure, or when the reversal portion 80 snaps, buckles, and reverses, the reversal portion 80 may break and lose reversibility. That is, by setting L/W within the above ranges, the bending strength of the reversal portion 80 is made flexible at a constant ratio for the elastic deformation portion 90, and the reversal portion 80 can be operated with a slight delay for the bending of the elastic deformation portion 90 that bears the handle skeleton. Therefore, even when an excessive brushing load is applied, it is possible to control the ease of reversing of the reversal portion 80 and the timing (threshold value) that triggers the reversal portion 80 to reverse.

The length of the reversal portion 80 in the long axis direction is 15 mm or more and 30 mm or less. The length is preferably 15 mm or more and 25 mm or less, more preferably 15 mm or more and 20 mm or less. The position of the tip end side end portion of the reversal portion 80 is the position of the tip end side end portion of the through-hole 73. The position of the rear end side end portion of the reversal portion 80 is the position of the rear end side end portion of the through-hole 73. In a case where the length of the reversal portion 80 in the long axis direction is less than 15 mm, it may be difficult for the reversal portion 80 to snap, buckle, and reverse due to the normal brushing pressure, and the deformation required for snap buckling to develop may not be generated. In a case where the length of the reversal portion 80 in the long axis direction exceeds 30 mm, the displacement required for snap buckling is significantly increased, which significantly reduces usability, and the deformation behavior of the reversal portion 80 may be the same as that of the elastic deformation portion 90.

The reversal portion 80 is located between the outer contour of the bristle tufting surface side 11 and the outer contour of the rear surface side of the elastic deformation portion 90 in the side view. More specifically, the position of the reversal portion 80 in the thickness direction is set so as not to protrude from the thickness of the elastic deformation portion 90 in the side view so that the reversal portion 80 does not form the outermost contour of the toothbrush. Therefore, for example, it is possible to prevent the reversal portion from coming into contact with the user during use. Specifically, it is preferable that the elastic deformation portion 90 be on the rear surface side of the position where the thickness is halved. In a case where the position of the reversal portion 80 in the thickness direction is on the rear surface side of the position where the thickness of the elastic deformation portion 90 is halved, when the reversal portion 80 is reversed to be in the second state, the possibility of the apex of the reversal portion 80 protruding from the front surface on the front surface side of the elastic deformation portion 90 and coming into contact with the user s finger can be reduced. In addition, since the reversal portion 80 is disposed on the rear surface side of the position where the thickness of the elastic deformation portion 90 is halved, when the reversal portion 80 is bent, the rear surface side is compressed rather than the front surface side, and therefore energy that triggers the reversing easily accumulates, and the strain energy can be efficiently transferred to the reversal portion 80.

The flexural modulus of the hard resin constituting the reversal portion 80 is preferably 1500 MPa or more and 3500 MPa or less, and more preferably 2000 MPa or more and 3500 MPa or less. In a case where the flexural modulus of the hard resin is less than 1500 MPa, the reversal portion 80 does not snap and buckle when deformed, and it may be difficult to sense that it is in an over-brushing state. In a case where the flexural modulus of the hard resin exceeds 3500 MPa, it may be difficult for the reversal portion 80 to snap, buckle, and reverse due to the over-brushing pressure, or when the reversal portion 80 snaps, buckles, and reverses, the reversal portion 80 may break and lose reversibility. In addition, by using a material having a defined flexural modulus, vibrations associated with snap buckling are intensively generated in a short time and are sensitive (sharp, large). As a result, the user can easily sense the over-brushing.

When the reversal portion 80 snaps and buckles, the moving distance of the apex of the protrusion shape in the thickness direction is preferably 0.2 mm or more and 5.0 mm or less. In a case where the moving distance of the apex in the thickness direction is less than 0.2 mm, the vibration at the time of snap buckling is decreased, and it may be difficult to sense the over-brushing state. In a case where the moving distance of the apex in the thickness direction exceeds 5.0 mm, it may be difficult for the reversal portion 80 to snap, buckle, and reverse due to the over-brushing pressure, or when the reversal portion 80 snaps, buckles, and reverses, the reversal portion 80 may break and lose reversibility. When the moving distance of the reversal portion 80 is within the above range when the snap buckling occurs, the vibration generated by the snap buckling is intensively generated in a short time and is sensitive (sharp, large). As a result, the user can easily sense the over-brushing.

The thickness of the hard portion 90H in the elastic deformation portion 90 is preferably 2.0 mm or less, and the width is preferably larger than the thickness. In a case where the thickness of the hard portion 90H is 2.0 mm or less, the hard portion 90H is in a plane stress state, and the hard portion 90H is unlikely to generate internal stress. As a result, the elastic deformation portion 90 is unlikely to break even when deformed, and the energy required for reversing the reversal portion 80 can be sufficiently accumulated.

In addition, in the toothbrush 1 of the present embodiment, since the reversal portion 80 and the elastic deformation portion 90 are disposed with a gap in the width direction, the sensing portion 70 can be more easily deformed on the front surface side and the rear surface side, and can be in a plane stress state where the sensing portion 70 is substantially not deformed in the long axis direction and the width direction. That is, in the toothbrush 1 of the present embodiment, the directions where the reversal portion 80 and the elastic deformation portion 90 are deformed are the thickness directions separated from each other in the width direction, and are not present on the same plane. In other words, a path where the elastic deformation portion 90 is deformed due to the external force in the thickness direction and a path where the reversal portion 80 is deformed due to the external force in the thickness direction are provided in a non-interfering manner. Therefore, in the toothbrush 1 of the present embodiment, since the elastic deformation portion 90 and the reversal portion 80 are unlikely to be constrained by each other and can be deformed, it is possible to more sufficiently accumulate the energy required for the reversing of the reversal portion 80, stress is intensively generated in the reversal portion 80 (particularly the groove portions 81 and 82), and a sharp snap buckling is developed.

In addition, since the toothbrush 1 of the embodiment is suppressed from being shaken in the width direction, the bending in the thickness direction due to brushing can be transmitted to the reversal portion 80 without loss. In addition, by disposing the reversal portion 80 and the elastic deformation portion 90 in the width direction, the bending of the elastic deformation portion 90 and the reversing of the reversal portion 80 can be made independent and the timing can be shifted. In a case where the elastic deformation portion 90 and the reversal portion 80 are disposed in the thickness direction, the roles of the bending of the elastic deformation portion 90 and the reversing of the reversal portion 80 may be hindered from each other.

As described above, in the toothbrush 1 of the present embodiment, the elastic deformation portion 90 that elastically deforms at least until an external force at which the reversal portion 80 snaps, buckles, and reverses, and the reversal portion 80 that snaps, buckles, and reverses due to an external force to the rear surface side which exceeds the threshold value are disposed with a gap in the width direction. Therefore, when an external force exceeding a predetermined threshold value is applied to the head portion 10 to the rear surface side, the user who grips the grip portion 30 can sense the over-brushing state where the external force applied to the head portion 10 on the rear surface side exceeds the threshold value due to the vibration when the reversal portion 80 snaps, buckles, and reverses.

EXAMPLE

Hereinafter, the present invention will be described in detail with reference to examples, but the present invention is not limited to the following examples, and can be appropriately modified and performed without departing from the gist thereof.

Examples 1 to 9, Comparative Examples 1 to 4

According to the specifications illustrated in [Table 1], toothbrushes having different flexural moduli and inclination angles θ of the reversal portion 80 were used as samples of Examples 1 to 9 and Comparative Examples 1 to 4. For Comparative Example 1, a toothbrush (Clinica Advantage Toothbrush manufactured by Lion Corporation) having no sensing portion (reversal portion and elastic deformation portion) was used as a sample. For Comparative Example 2, a toothbrush in which the elastic deformation portion and the reversal portion were disposed in the thickness direction was used as a sample with respect to the sample of Example 2. For Comparative Example 3, a toothbrush including a sensing portion having only a reversal portion without an elastic deformation portion was used as a sample with respect to the sample of Example 2. For Comparative Example 4, a toothbrush including a sensing portion in which the elastic deformation portion and the reversal portion were joined and without a gap between the elastic deformation portion and the reversal portion was used as a sample with respect to the sample of Example 2.

Evaluation Method (1) Vibration Development of Reversal Portion

[Test method] A specialized panel (5 people) brushed with each sample and evaluated whether or not vibration was felt when the reversal portion was reversed on a 5-point scale in actual use, and the average value of the scores was evaluated as follows. The average value of the scores was rounded off between the second decimal place and the first decimal place.

[Score] 5 points: Significantly felt, 4 points: Felt, 3 points: Slightly felt, 2 points: Not felt much, 1 point: Not felt at all

[Evaluation] ◎: 4.6 to 5 points, ○: 4.1 to 4.5 points, Δ: 3.1 to 4.0 points, ×: 3.0 points or less (2) Reversible Reversing of Reversal Portion

[Test method] A specialized panel (5 people) used each sample for 1 week and evaluated the presence or absence of reversing after 1 week.

[Evaluation] ○: Presence of reversing and ×: Absence of reversing (× when not even one piece was reversed)

(3) Vibration Development at Approximately 200 to 250 g

[Test method] For each sample, the grip portion 30 side was fixed from the boundary between the sensing portion 70 and the grip portion 30 so that the bristle tufting surface of the head portion was horizontal. A test was performed in which a load was applied to the bristle tufting surface of the head portion on the rear surface side in the thickness direction. A push-pull gauge (DS2-50N, manufactured by IMADA CO., LTD.) was used to push the center in the front view of the bristle tufting surface in the head portion, and the load when the reversal portion was reversed was measured.

The measurement was performed three times, and the average value was used as a measured value. For the average value, the first decimal place was rounded off.

[Evaluation] ◎: 200 to 250 g, ○: 251-300 g, Δ: 150 to 199 g, ×: 149 g or less, or 301 g or more, –: No vibration For the evaluation results, ◎, ○, and Δ were regarded as passing (OK), and × was evaluated as failing (NG).

In the evaluation of the measured load, by developing the vibration at the time of reversing in the range of 230 to 250 g, for example, the load when the user actually brushes with the toothbrush 1 is a value of 200 g, which is the recommended value.

As illustrated in [Table 1], in the samples of Examples 1 to 9 in which the flexural modulus was 1500 MPa or more and 3500 MPa or less, and the inclination angle θ of the reversal portion was in the range of 5 degrees or more and 11 degrees or less, it was confirmed that the vibration accompanying the reversing of the reversal portion, the reversible reversing of the reversal portion, and the vibration with a load of approximately 200 to 250 g were sufficiently developed.

On the other hand, even when the flexural modulus was in the range of 1500 MPa or more and 3500 MPa or less, the sample of Comparative Example 1 having no sensing portion (reversal portion and elastic deformation portion) did not reverse itself, and therefore the vibration accompanying the reversing of the reversal portion and the vibration development at a load of approximately 200 to 250 g did not occur. In addition, in the range where the elastic modulus was 1500 MPa or more and 3500 MPa or less and the inclination angle θ of the reversal portion was in the range of 5 degrees or more and 11 degrees or less, even when a value represented by T/t and a value represented by L/W were in the range of 0.05 or more and 0.35 or less, for each of the sample of Comparative Example 2 in which the elastic deformation portion and the reversal portion were disposed in the thickness direction, and the sample of Comparative Example 3 including a sensing portion having only a reversal portion without an elastic deformation portion, the vibration accompanying the reversal of the reversal portion and the vibration development at a load of approximately 200 to 250 g did not occur.

Furthermore, in the range where the elastic modulus was 1500 MPa or more and 3500 MPa or less and the inclination angle θ of the reversal portion was 5 degrees or more and 11 degrees or less, even when a value represented by T/t and a value represented by L/W were in the range of 0.05 or more and 0.35 or less, for the sample of Comparative Example 4 including a sensing portion in which the elastic deformation portion and the reversal portion were joined and without a gap between the elastic deformation portion and the reversal portion, although vibration occurred due to the reversing of the reversal portion, vibration development at a load of approximately 200 to 250 g did not occur.

TABLE 1

| | Example 1 | Example 2 | Example 3 | Example 4 | Example 5 | Example 6 | Example 7 |
|---|---|---|---|---|---|---|---|
| Flexural modulus (MPa) | 2000 | 2500 | 3000 | 2500 | 2500 | 1500 | 3500 |
| Inclination angle θ of reversal portion 80 (degree) | 8 | 8 | 8 | 5 | 11 | 8 | 8 |

TABLE 1-continued

| | | | | | | | |
|---|---|---|---|---|---|---|---|
| T/t | 0.15 | 0.15 | 0.15 | 0.15 | 0.15 | 0.15 | 0.15 |
| L/W | 0.14 | 0.14 | 0.14 | 0.14 | 0.14 | 0.14 | 0.14 |
| Vibration development of reversal portion | ○ | ◎ | ◎ | ○ | ◎ | ○ | ◎ |
| Reversible reversing | Presence | Presence | Presence | Presence | Presence | Presence | Presence |
| Vibration development of reversal portion at approximately 200 to 250 g | ◎ | ◎ | ○ | Δ | ○ | Δ | ○ |

| | Example 8 | Example 9 | Comparative Example 1 | Comparative Example 2 | Comparative Example 3 | Comparative Example 4 |
|---|---|---|---|---|---|---|
| Flexural modulus (MPa) | 2500 | 2500 | 2500 | 2500 | 2500 | 2500 |
| Inclination angle θ of reversal portion 80 (degree) | 8 | 8 | — | 8 | 8 | 8 |
| T/t | 0.05 | 0.35 | — | 0.15 | 0.15 | 0.15 |
| L/W | 0.05 | 0.35 | — | 0.14 | 0.14 | 0.14 |
| Vibration development of reversal portion | Δ | ◎ | X | X | X | ○ |
| Reversible reversing | Presence | Absence | Absence | Absence | Absence | Presence |
| Vibration development of reversal portion at approximately 200 to 250 g | Δ | ○ | — | — | — | X |

Although the preferred embodiments according to the present invention are described above with reference to the accompanying drawings, it goes without saying that the present invention is not limited to the above examples. The various shapes and combinations of the constituent members described in the above-described examples are examples, and can be variously changed based on design requirements and the like without departing from the gist of the present invention.

For example, although the configuration in which the sensing portion 70 is provided between the neck portion 20 and the grip portion 30 is illustrated in the above embodiment, the invention is not limited to this configuration. The sensing portion 70 may have a configuration provided in the neck portion 20 or a configuration provided in the grip portion 30.

In addition, although the configuration in which one reversal portion 80 is provided in the sensing portion 70 is illustrated in the above embodiment, the invention is not limited to this configuration, and a configuration in which a plurality of reversal portions 80 are provided may be provided.

For example, in a case where two reversal portions 80 are provided, one is formed to have a thickness and inclination angle θ that are reversed at the upper limit value of the appropriate brushing load, and the other is formed to have a thickness and inclination angle θ that are reversed at the lower limit value of the appropriate brushing load. Therefore, it is possible to easily define both the upper limit value and the lower limit value of the brushing load.

In addition, although the configuration in which the reversal portion 80 is reversed in the thickness direction is illustrated in the above embodiment, the invention is not limited to this configuration. For example, the reversal portion 80 may be configured to be reversed in the width direction, or in a diagonal direction orthogonal to the long axis direction and intersecting the width direction and the thickness direction. By adopting a configuration in which the reversal portion 80 is reversed in the diagonal direction, it is possible to sense over-brushing during brushing by a rolling method.

INDUSTRIAL APPLICABILITY

The present invention can be applied to a toothbrush.

REFERENCE SIGNS LIST

1: Toothbrush
2: Handle body
10: Head portion
11: Bristle tufting surface
20: Neck portion
30: Grip portion
70: Sensing portion
80: Reversal portion
81, 82: Groove portion
E, 31E, 32E: Soft portion
H: Hard portion
K: Through-hole
S: Gap

What is claimed is:

1. A toothbrush comprising:

a head portion provided on a tip end side in a long axis direction and having a bristle tufting surface;

a grip portion disposed on a rear end side from the head portion; and a neck portion disposed between the bristle tufting surface and the grip portion, wherein a sensing portion for sensing that an external force in a first direction orthogonal to the bristle tufting surface exceeds a threshold value is provided on a rear end side from the bristle tufting surface, the sensing portion includes a reversal portion that connects a first region on the tip end side from the sensing portion and a second region on the rear end side from the sensing portion, and that snaps, buckles, and reverses as the head portion is displaced on a rear surface side opposite to the bristle tufting surface in the first direction due to the external force exceeding the threshold value, and an elastic deformation portion that is disposed with a gap from the reversal portion, connects the first region and the second region, and elastically deforms at least up to the external force at which the reversal portion snaps, buckles, and reverses, the reversal portion is located between an outer contour on the bristle tufting surface side and an outer contour on the rear surface side of the elastic deformation portion in a side view viewed in a direction orthogonal to the long axis direction and the first direction, wherein, when a maximum thickness of the reversal portion in the first direction is T, and a maximum thickness of the elastic deformation portion in the first direction is t, $0.35 \geq T/t \geq 0.05$.

2. The toothbrush according to claim 1, wherein a path in which the elastic deformation portion is deformed by the external force in the first direction and a path in which the reversal portion is deformed by the external force in the first direction are provided in a non-interfering manner.

3. The toothbrush according to claim 2, wherein the elastic deformation portion and the reversal portion are disposed with a gap in a second direction orthogonal to the first direction and the long axis direction.

4. The toothbrush according to claim 3, wherein the reversal portion is provided in a center in the second direction, and the elastic deformation portions are provided on both sides in the second direction with the reversal portion interposed therebetween.

5. The toothbrush according to claim 4, wherein the reversal portion has a protrusion shape toward the rear surface side when the external force in the first direction is equal to or less than the threshold value, and is reversed in a protrusion shape toward the bristle tufting surface side when the external force in the first direction exceeds the threshold value.

6. The toothbrush according to claim 5, wherein, when the external force in the first direction is equal to or less than the threshold value, the reversal portion is inclined in a direction toward the bristle tufting surface side from an apex of the protrusion shape toward an end portion in the long axis direction, and an angle at which the reversal portion is inclined with respect to a plane parallel to each of the first direction and the long axis direction is 5 degrees or more and 11 degrees or less.

7. The toothbrush according to claim 6, wherein the reversal portion includes a groove portion extending in the second direction on at least one of the bristle tufting surface side and the rear surface side in a region including an apex of the protrusion shape.

8. The toothbrush according to claim 7, wherein, when the reversal portion snaps, buckles, and reverses, a moving distance of an apex of the protrusion shape in the first direction is 0.2 mm or more and 5.0 mm or less.

9. The toothbrush according to claim 1, wherein, when a maximum width of the reversal portion in the second direction is L, and a maximum width of the elastic deformation portion in the second direction is W, $0.35 \geq L/W \geq 0.05$.

10. The toothbrush according to claim 9, wherein the reversal portion is made of a hard resin, and a portion of the elastic deformation portion is made of a resin having a hardness different from that of the hard resin.

11. The toothbrush according to claim 10, wherein a flexural modulus of the hard resin is 1500 MPa or more and 3500 MPa or less.

12. The toothbrush according to claim 11, wherein a portion of the elastic deformation portion is made of a soft resin.

13. The toothbrush according to claim 12, wherein the gap is a through-hole extending in the first direction.

* * * * *